US006913546B2

(12) United States Patent
Kakiuchi

(10) Patent No.: US 6,913,546 B2
(45) Date of Patent: Jul. 5, 2005

(54) WOOD-TYPE GOLF CLUB HEAD

(75) Inventor: Hisashi Kakiuchi, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/421,864

(22) Filed: Apr. 24, 2003

(65) Prior Publication Data

US 2003/0207727 A1 Nov. 6, 2003

(30) Foreign Application Priority Data

May 1, 2002 (JP) ..... 2002-130010

(51) Int. Cl.[7] ..... A63B 53/04
(52) U.S. Cl. ..... 473/345; 473/349
(58) Field of Search ..... 473/324–350

(56) References Cited

U.S. PATENT DOCUMENTS 4,840,380 A * 6/1989 Kajita et al. ..... 473/291
6,171,989 B1 * 1/2001 Yoshida ..... 501/93
6,254,494 B1 * 7/2001 Hasebe et al. ..... 473/349
6,632,304 B2 * 10/2003 Oyama et al. ..... 148/671

FOREIGN PATENT DOCUMENTS

JP 11-33145 A 2/1999

* cited by examiner

*Primary Examiner*—Sebastiano Passaniti
(74) *Attorney, Agent, or Firm*—Birch, Stewart, Kolasch & Birch, LLP

(57) ABSTRACT

A wood-type golf club head comprises a club face provided with a high-resilience part whose Young's modulus E is in a range of from 40 to 80 GPa. The head volume is in a range of from 270 to 420 cc. The horizontal inertial moment is in a range of from 3000 to 4500 (g·sq.cm), and the gravity point depth is in a range of from 15 to 25 mm.

18 Claims, 6 Drawing Sheets

WOOD-TYPE GOLF CLUB HEAD

BACKGROUND OF THE INVENTION

The present invention relates to a wood-type golf club head, more particularly to an improved overall structure capable of improving the distance and direction of the ball flights.

In recent years, wood-type golf clubs are increased in the head volume to enlarge the sweet area. At the same time, in order to prevent the club head weight from increasing, the thickness of material is minimized in various portions including the face portion.

On the other hand, the increase in the club head size is accompanied by an increase in the gravity point depth from the club face, and as a result, if the ball hitting position is at toe-side or heel-side of the sweet spot, then the sidespin of the ball is increased by the gear effect, which results in a hook or slice tendency.

In such a large-sized club head, if the Young's modulus of the face portion is decreased, as the flexure of the face portion at impact increases, the contact time of the face portion with the ball also increases, which also increases the sidespin, and the directional difference from the target is very likely to increase.

SUMMARY OF THE INVENTION

It is therefore, an object of the present invention to provide a wood-type golf club head in which, even if the head volume is relatively large and the Young's modulus of the face portion is relatively low, the hook/slice ball flight tendency at the time of off-center shot is minimized, and the directional stability is improved while increasing the traveling distance.

According to the present invention, a wood-type golf club head comprises a club face provided with a high-resilience part whose Young's modulus E is in a range of from 40 to 80 GPa, a head volume in a range of from 270 to 420 cc, a horizontal inertial moment in a range of from 3000 to 4500 (g·sq.cm), and a gravity point depth in a range of from 15 to 25 mm.

Preferably, a ratio (A/B) of a width (A) of the club head measured in a toe-heel direction to a length (B) of the club head measured in a perpendicular direction to the toe-heel direction is set in a range of from 1.5 to 2.5. The gravity point depth is set in a range of from 15 to 20 mm. The high-resilience part is made of a titanium alloy defined by the following composition formula:

$$Ti_{100-x-y}M1_xM2_y \text{ (x and y values are atom \%)}$$

wherein

M1 is at least one element selected from a group consisting of Zr and Hf,

M2 is at least one element selected from a group consisting of V, Nb, Ta, Mo, Cr and W, $$x+y=<50,\ 0<x<50, \text{ and } 0<y<50.$$

DESCRIPTION OF THE PREFERRED EMBODIMENTS

Figure 1:
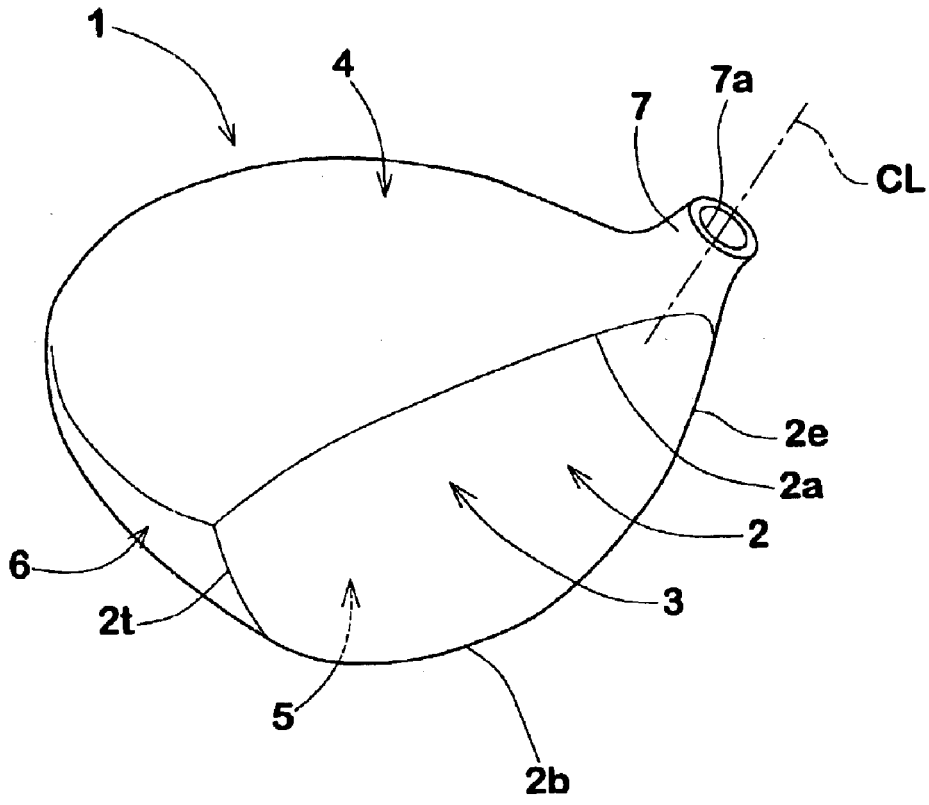
FIG. 1 is a perspective view of a wood-type golf club head according to the present invention.

Embodiments of the present invention will now be described in detail in conjunction with the accompanying drawings.

In the drawings, wood-type golf club head 1 according to the present invention comprises a face portion 3 whose front face defines a club face 2 for striking a ball, a crown portion 4 intersecting the club face 2 at the upper edge 2*a* thereof, a sole portion 5 intersecting the club face 2 at the lower edge 2*b* thereof, a side portion 6 between the crown portion 4 and sole portion 5 which extends from a toe-side edge 2*t* to a heel-side edge 2*e* of the club face 2 through the back face of the club head, a neck portion 7 to be attached to an end of a club shaft (not shown), and a coating layer covering a surface of the head.

The wood-type golf club head 1 is a hollow metal head. If the head volume is too small, it is difficult to enlarge the sweet area, but if too large, it becomes difficult to handle. Therefore, the volume of the head 1 is set in a range of from 270 to 420 cc, preferably 300 to 400 cc, more preferably 350 to 400 cc.

Figure 5:
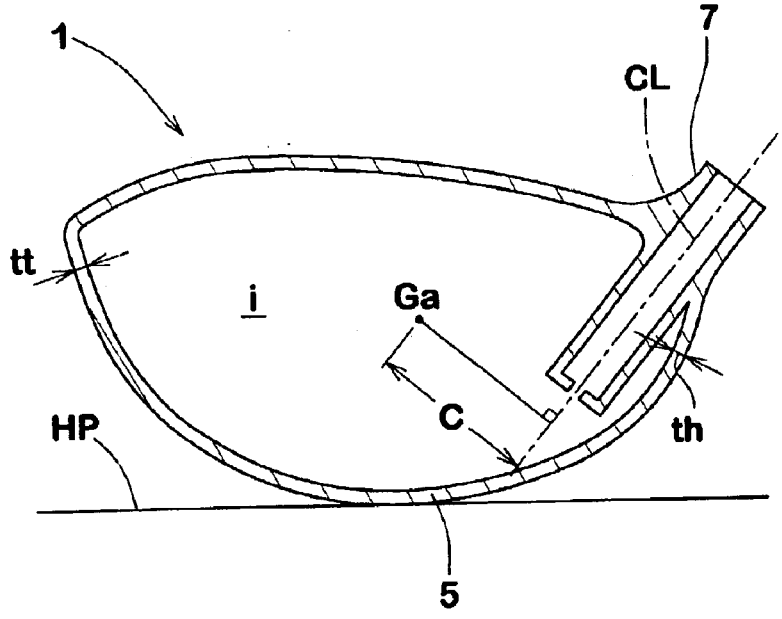
FIG. 5 is a cross sectional view thereof taken along vertical plane VP1 in FIG. x3.
Figure 6:
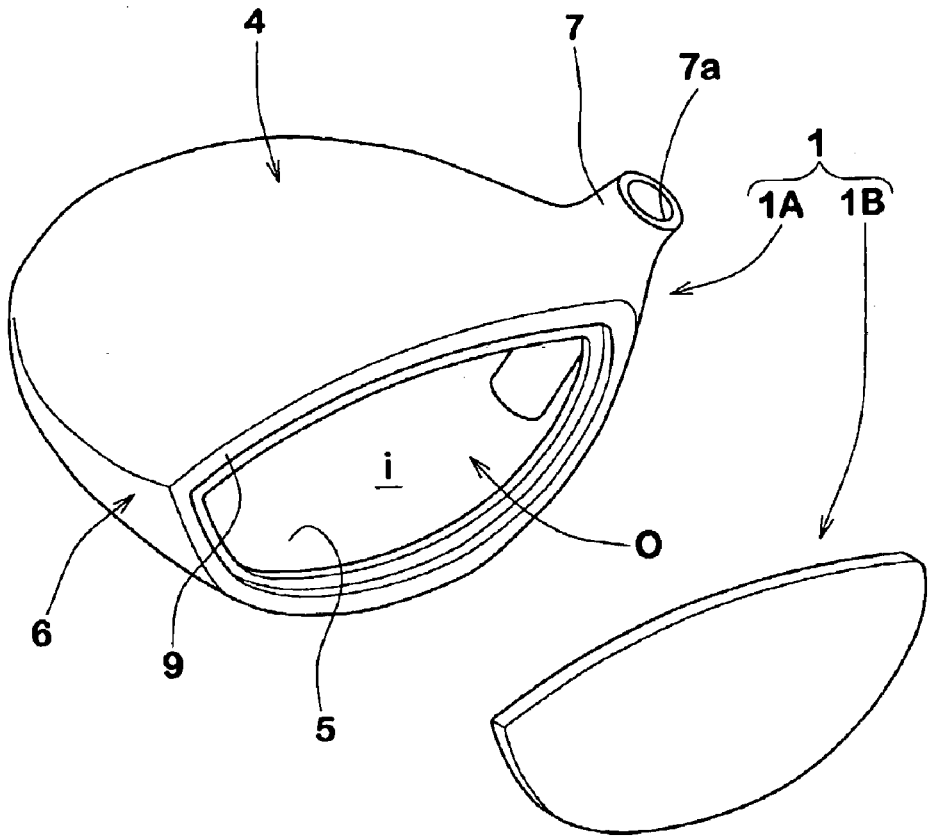
FIG. 6 is an exploded perspective view showing a two-piece structure employed in the golf club head showing FIG. 1.

The neck portion 7 is provided with a shaft inserting hole 7*a* having an opening for the club shaft at the upper end thereof. In this embodiment, the neck portion 7 comprises an inner tubular part extended into the cavity (i) as shown in FIGS. 5 and 6. The tubular part terminates in the cavity (i) in this example. But, it is also possible to extend the tubular part to the inner surface of the sole portion 5 to secure the lower end thereto. In any case, the center axis (CL) of the shaft inserting hole 7*a* can be used instead of the center axis of the inserted club shaft when setting up the club head alone in the undermentioned measuring state. Incidentally, the above-mentioned head volume includes the volume of the shaft inserting hole 7*a* which opens at the top of the neck portion 7.

Figure 2:
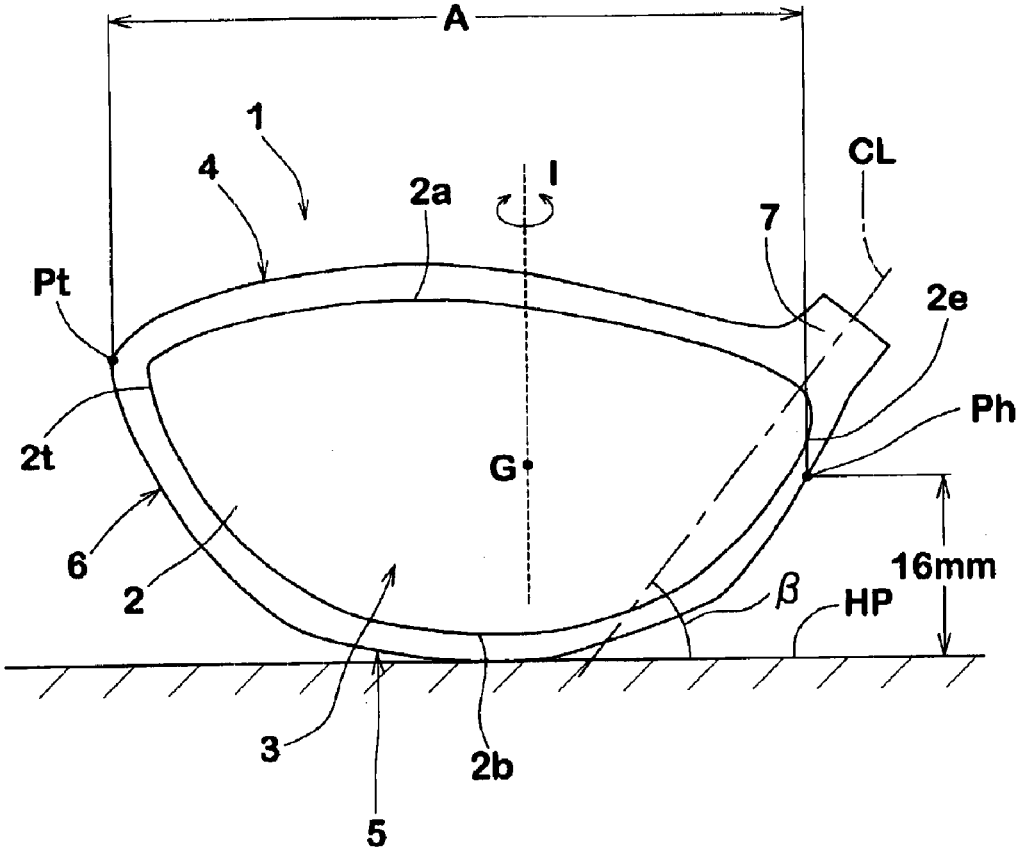
FIG. 2 is a front view thereof.
Figure 3:
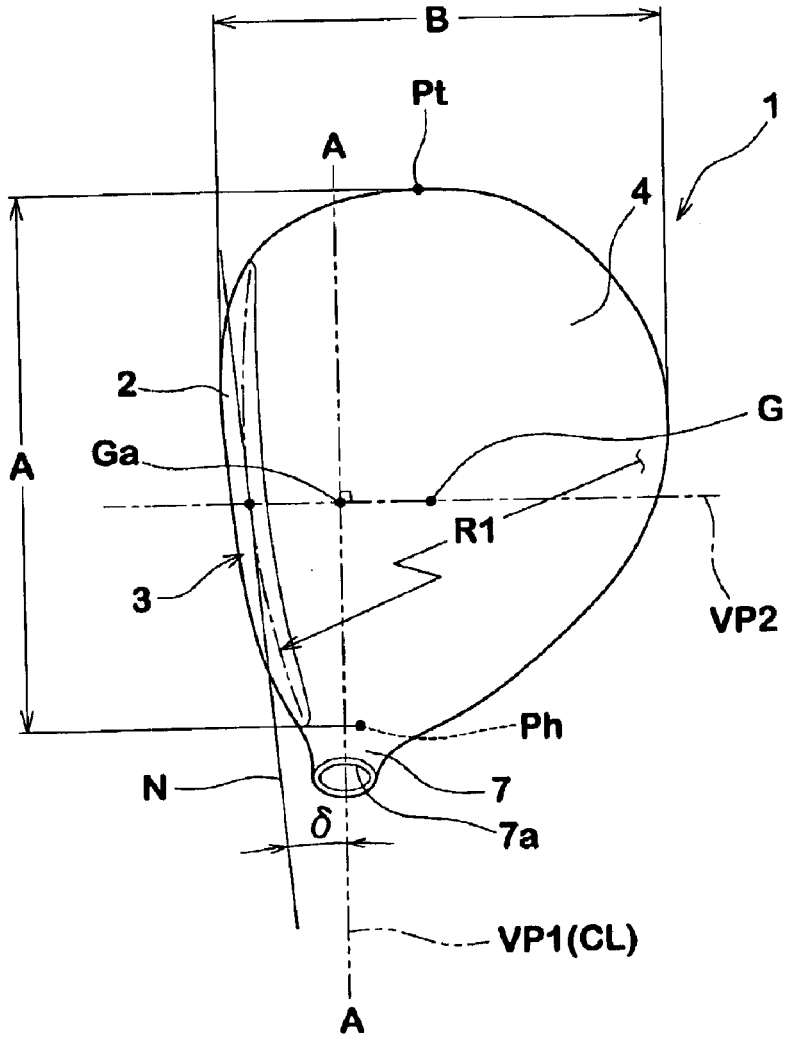
FIG. 3 is a top view thereof.

In FIGS. 1–5, the club head 1 is in its measuring state. The measuring state is such that, as shown in FIGS. 2 and 3, the club head 1 is placed on a horizontal plane HP, so that the shaft center axis CL inclines at its lie angle β within a vertical plane VP1, and the club face 2 inclines at its face angle δ with respect to the vertical plane VP1. Here, the face angle δ is the angle between the vertical plane VP1 and a horizontal tangential line N to the centroid of the club face 2.

In this embodiment, the club head 1 has a two-piece structure which, as shown in FIG. 6, comprises a main body 1A provided at the front with an opening O, and a face member 1B fixed on the front of the main body 1A so as to close the opening o.

The main body 1A is composed of the above-mentioned crown portion 4, sole portion 5, side portion 6 and neck portion 7 and further an annular front portion 9 which forms a periphery of the club face 2 surrounding the opening O.

For the main body 1A, various metal materials such as titanium alloys, pure titanium, aluminum alloys and stainless steel and further fiber reinforced resins may be used. Preferably, a metal material whose strength per density is high such as titanium alloys is used. In this example, the main body 1A is an integral molding of an alpha-beta-type titanium alloy (Ti-6Al-4V) formed by lost-wax precision casting.

The face member 1B in this example is a platy metal part which forms the substantial part of the club face 2. The face member 1B is put in the opening O and fixed to the main body 1A by means of welding, adhesive bonding, caulking, press fitting or the like. In this embodiment, welding is used.

In this embodiment, therefore, the face portion 3 is provided with a high-resilience part 8 which is defined by the face member 1B. The high-resilience part 8 is defined as having a relatively low Young's modulus E of not more than 80 GPa, preferably not more than 60 GPa, but not less than 40 GPa, preferably not less than 45 GPa. The face member 1B in this embodiment, thus has such a low Young's modulus E.

The high-resilience part 8 creates a large flexure at impact and a ball is launched with a large power of restitution. Thus, the power loss is minimized to maximize the launching speed of the ball. If the Young's modulus E exceeds 80 GPa, the mechanical impedance of the club head 1 becomes larger than that of the golf balls, and the effect to increase the launching speed or the initial ball speed is decreased. If the Young's modulus E is less than 40 GPa, it is difficult to keep the necessary durability.

As the metal material satisfying the above-mentioned modulus limitation, various metal alloys may be used. For example, in case of crystalline alloys, titanium-zirconium alloys may be preferably used. In case of amorphous alloys, for example, amorphous zirconium alloys are preferably used for the workability. Especially, titanium alloys defined by the following particular composition formula (1) are preferably used.

$$Ti_{100-x-y}M1_xM2_y \text{ (x and y values are atom \%)} \quad (1)$$

wherein,

M1 is a component including at least one element selected from a group consisting of Zr and Hf,

M2 is a component including at least one element selected from a group consisting of V, Nb, Ta, Mo, Cr and W, $$0<x<50,\ 0<y<50, \text{ and } x+y=<50.$$

Especially, it is preferable that Nb and/or Ta whose specific gravity is large is used as the component M2.

As to the thickness of the face member 1B or the high-resilience part 8, in at least a central region including the sweet spot SS, preferably the whole of the member 1B or part 8, the thickness (t) is set in a range of not less than 1.5 mm, preferably not less than 2.0 mm, more preferably not less than 2.4 mm, but not more than 4.0 mm, preferably not more than 3.0 mm, more preferably not more than 2.8 mm. If the thickness (t) is less than 1.5 mm, it is difficult to keep the necessary strength and durability. If the thickness (t) is more than 4.0 mm, the rigidity increases, and it becomes difficult to increase the ball flight.

Figure 4:
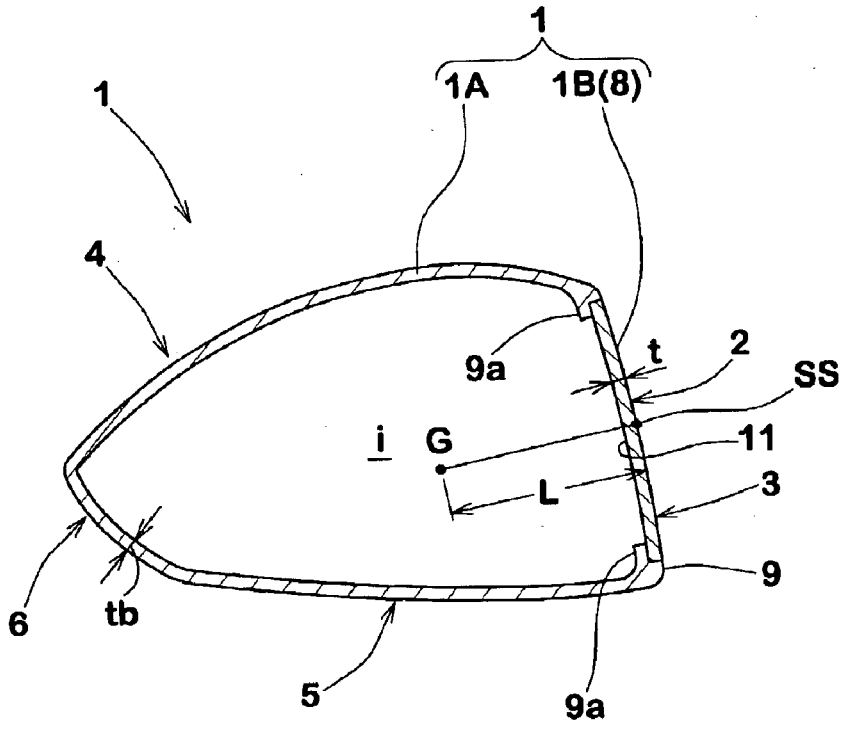
FIG. 4 is a cross sectional view thereof taken along Vertical plane VP2 in FIG. x3.

In this embodiment, as the face member 1B is platy, in order to support the edge portion thereof, a back support 9*a* protruding from the annular front portion 9 into the opening O is formed around the opening O to support the back face 11 of the face member 1B as shown in FIGS. 4 and 6. As the face member 1B is thin, the back support 9*a* in this example is continuously or annularly formed. But, it is also possible to form discontinuously at appropriate intervals.

In any case, it is preferable that the total contact area of the back support 9*a* with the back face of the face member 1B is set in the range of at most 20%, preferably less than 10%, more preferably less than 5% but preferably at least 2% of the overall area s of the club face 2, whereby the fixing strength of the face member 1B is improved without hindering the flexure of the face member 1B at impact.

According to the present invention, the horizontal inertial moment I (g·sq.cm) of the club head 1 is set in a range of not less than 3000, preferably not less than 3300, more preferably not less than 3500, but not more than 4500, preferably not more than 4000. Here, the horizontal inertial moment I is defined as an inertial moment around a vertical axis passing through the gravity point G of the club head under the above-mentioned club head measure state.

In order to increase the horizontal inertial moment I in the large-sized club head 1, an improvement is made on the shape of the club head while increasing the specific gravity of the face portion (or face member 1B) at the same time.

As to the shape of the club head, the aspect ratio (A/B) of the club head width (A) to the club head length (B) is set in the range of from 1.5 to 2.5, preferably 2.0 to 2.5. Here, as shown in FIGS. 2 and 3, under the measuring state, the club head width (A) is defined as the maximum length measured horizontally between a toe point Pt and a heel point Ph in the toe-heel direction or in parallel along the vertical plane VP1, wherein the toe point Pt is defined as the extreme end in a horizontal direction being parallel the vertical plane VP1, and the heel point Ph is defined as the extreme end in a horizontal plane at a height of 16 mm from the above-mentioned horizontal plane HP. The length B is defined as the maximum length measured between the extreme ends in a perpendicular direction to the vertical plane VP1.

In addition to such arrangement of the shape, as shown in FIGS. 4 and 5, preferably the thickness of the side portion 6 is arranged such that the thickness tt of the toe-side and the thickness th of the heel-side are more than the thickness tb of the back side.

In order to increase the specific gravity of the face portion, the specific gravity of the face member 1B (which forms substantially the whole of the face portion) is increased into a range of not less than 4.5, preferably not less than 5.0, more preferably not less than 5.5, but not more than 8.0, preferably not more than 7.0.

This specific gravity is larger than that of the titanium alloy of the head main body 1A, which contributes to decrease the gravity point depth L.

In order to increase the specific gravity of the face portion, the face member 1B is formed out of a titanium alloy defined by the above-mentioned composition formula (1), of which specific gravity is increased by increasing the quantity of high specific gravity element(s) in the alloy, namely, Nb (Niobium whose specific gravity is about 8.5) and/or Ta (Tantalum whose specific gravity is about 16.6) is increased, whereby it becomes possible to increase the specific gravity while maintaining the Young's modulus low, and accordingly the gravity point G is shifted towards the club face. Therefore, the total of Nb and Ta is set in the range of 10 to 40 atom %, more preferably not less than 30 atom %. It is preferable that both of Nb and Ta are included as the component M2 in the alloy.

Further, by using the above-mentioned specific materials, thickness distribution, shape limitation and the like, the gravity point distance C is set in the range of not less than 25 mm, preferably not less than 30 mm, but not more than 40 mm, preferably not more than 35 mm. Here, the gravity point distance C is defined, under the club head measure state, as the distance from the shaft center axis CL, of a projected gravity point Ga which is the gravity point G projected on the vertical plane VP1 as shown in FIGS. 3 and 5.

Furthermore, the gravity point depth L is set in the range of not less than 15 mm, but not more than 25 mm, preferably not more than 20 mm, more preferably not more than 17 mm. Here, the gravity point depth L is defined as a distance between the gravity point G and the sweet spot SS. The sweet spot SS is, as shown in FIG. 4, defined as the intersecting point of a normal line with the club face 2, which normal line is drawn from the gravity point G to the club face 2.

In general, the toe of a large-sized club head tends to becomes backwards at impact than at the time of the address. However, by decreasing the gravity point distance C to the above-mentioned range, the inertial moment of the club head around the shaft center axis CL is decreased, and as a result, at the time of impact, the toe returns to the position at address and the directional stability of the struck ball will be improved. As a result, it becomes possible for the average golfers to shot a draw ball to increase the traveling distance.

Comparison Tests

According to the specifications given in Table 1, plural kinds of wood-type golf club heads for #1 driver were made by way of test, and measured for the restitution coefficient as follows. (Head volume: 350 cc, Bulge radius: 304.8 mm, Roll radius: 304.8 mm)

Further, the club heads were attached to the identical carbon shafts (Flex R) and 45-inch wood clubs (#1 driver) were made, and the following hitting test was performed.

The horizontal inertial moment I was measured using a moment of inertia measuring instrument manufactured by Inertia Dynamics, Inc.

Restitution Coefficient Test

According to the "Procedure for Measuring the velocity Ratio of a Club Head for conformance to Rule 4-1e, Appendix II, Revision 2 (Feb. 8, 1999), United states Golf Association.", the restitution coefficient "e" was obtained using the following equation:

$$Vo/Vi=(eM-m)/(M+m)$$

wherein

Vo: ball rebound velocity

Vi: ball incoming velocity

M: the mass of the club head m: the mass of the ball.

As specified therein, the golf balls used were "Titleist, PINNACLE GOLD" and the radius of the target circle centered on the sweet spot was 5 mm. The distance between the club face and the launching device was 55 inches, and the incoming ball velocity was 160±0.5 feet/sec. The test results are shown in Table 1.

Hitting Test

Figure 7:
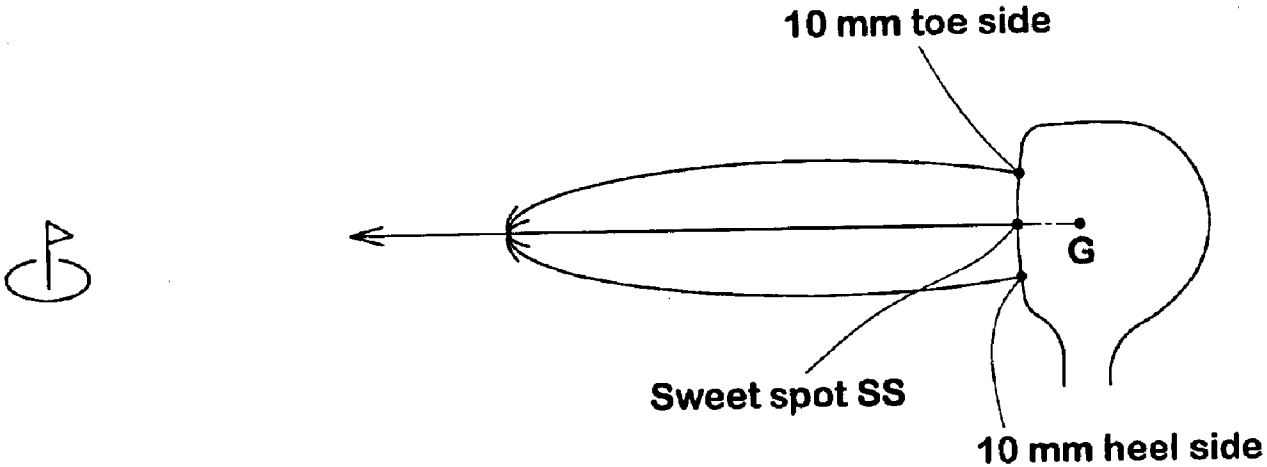
FIG. 7 is a diagram for explaining horizontal ball flight courses at the time of an on-center hit and off-center hits in the golf club head according to the present invention.
Figure 8:
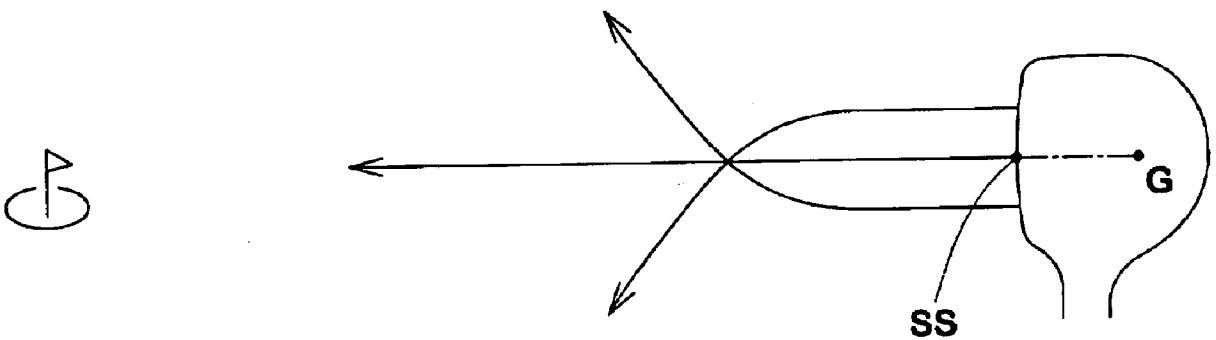
FIG. 8 is a diagram for explaining horizontal ball flight courses at the time of an on-center hit and off-center hits in a golf club head having a deep gravity point.

Each of the golf club was attached to a swing robot, and three-piece golf balls (MAXFLI HI-BRID, Sumitomo Rubber Ind., Ltd.) were hit at a head speed of 40 m/s, wherein the hitting was made five times at each of three positions par a head, namely, the sweet spot SS and two positions 10 mm toe-side and 10 mm heel-side from the sweet spot as shown in FIG. 7, and the difference between the target line and the point of ball fall was measured rightward or leftward. The average of the measured values for five time hitting at each position is shown in Table 1.

TABLE 1

| Head | Ref.1 | Ex.1 | Ex.2 | Ex.3 | Ex.4 | Ex.5 |
|---|---|---|---|---|---|---|
| Real loft angle (deg.) | 11 | 11 | 11 | 11 | 11 | 11 |
| Head volume (cc) | 350 | 350 | 350 | 350 | 350 | 350 |
| Head Weight (g) | 195 | 195 | 195 | 195 | 195 | 195 |
| Face member | | | | | | |
| Composition | Ti—6Al—4V | $Ti_{70}Zr_{15}Nb_{10}Cr_5$ | $Ti_{70}Zr_{30}Nb_{10}Ta_{10}$ | $Ti_{50}Zr_{20}Nb_{10}Ta_{20}$ | $Ti_{50}Zr_{20}Nb_{10}Ta_{20}$ | $Ti_{50}Zr_{20}Nb_{10}Ta_{20}$ |
| Specific gravity | 4.4 | 5.4 | 6.7 | 7.7 | 7.7 | 7.7 |
| Young's modulus (GPa) | 120 | 75 | 60 | 45 | 45 | 45 |
| Thickness (mm) | 2.7 | 2.7 | 2.7 | 2.7 | 2.7 | 2.7 |
| Width/length ratio (A/B) | 1.15 | 1.8 | 2.1 | 2.35 | 2.35 | 2.35 |
| Gravity point depth L (mm) | 38 | 18.5 | 16.5 | 15.5 | 15.5 | 15.5 |
| Gravity point distance C (mm) | 42 | 35 | 35 | 30 | 33 | 35 |
| Inertial Moment I (g · sq.cm) | 3200 | 3400 | 3600 | 3900 | 3900 | 3900 |
| Restitution coefficient | 0.83 | 0.852 | 0.859 | 0.868 | 0.864 | 0.865 |
| Directional difference (m) | | | | | | |
| Sweet spot hitting | 4.6 | −1.2 | −2,3 | 1.9 | 2.5 | 2.4 |
| Toe-side hitting | −7.6 | −5.2 | −5.4 | −1.4 | −3.2 | −3 |
| Heel-side hitting | 8.3 | 6.5 | 6 | 3,2 | 4.9 | 4.3 |

As described above, in the wood-type golf club head according to the present invention, as the face portion has the high-resilience part, the traveling distance may be improved. and as the horizontal inertial moment is relatively large and the gravity point depth is small, even if the ball hits at a position off the sweet spot toward the toe or heel, the difference of the ball flight from that at the sweet spot decreases, in other words, the gear effect is decreased to lessen the sidespin and the directional stability is improved.

What is claimed is:

1. A wood-type golf club head comprising a club face provided with a high-resilience part whose Young's modulus E is in a range of from 40 to 80 GPa, a head volume in a range of from 270 to 420 cc, a horizontal inertial moment in a range of from 3000 to 4500 (g·sq.cm), and a gravity point depth in a range of from 15 to 25 mm, wherein a ratio (A/B) of a width (A) of the club head measured in a toe-heel direction to a length (B) of the club head measured in a perpendicular direction to the toe-heel direction is in a range of from 1.5 to 2.5.

2. A wood-type golf club head according to claim 1, wherein the ratio (A/B) is in a range of from 2.0 to 2.5.

3. A wood-type golf club head according to claim 1, wherein the gravity point depth is in a range of from 15 to 20 mm.

4. A wood-type golf club head according to claim 1, wherein the high-resilience part is made of a titanium alloy defined by the following composition formula:

$Ti_{100-x-y}M1_xM2_y$ (x and y values are atom %)

wherein

M1 is a component including at least one element selected from a group consisting of Zr and Hf, M2 is a component including at least one element selected from a group consisting of V, Nb, Ta, Mo, Cr and W, $x+y=<50$, $0<x<50$, and $0<y<50$.

5. A wood-type golf club head according to claim 1, wherein the gravity point depth is not more than 17 mm.

6. A wood-type golf club head according to claim 1, wherein the Young's modulus is not more than 60 GPa.

7. A wood-type golf club head according to claim 1, wherein the Young's modulus is not less than 45 GPa.

8. A wood-type golf club head according to claim 1, wherein the head volume is in a range of from 300 to 400 cc.

9. A wood-type golf club head according to claim 1, wherein the head volume is in a range of from 350 to 400 cc.

10. A wood-type golf club head according to claim 1, wherein the horizontal inertial moment is not less than 3300 g·sq.cm.

11. A wood-type golf club head according to claim 1, wherein the horizontal inertial moment is not less than 3500 g·sq.cm.

12. A wood-type golf club head according to claim 1, wherein the horizontal inertial moment is not more than 4000 g·sq.cm.

13. A wood-type golf club head according to claim 1, wherein the titanium alloy includes 10 to 40 atom % of Nb.

14. A wood-type golf club head according to claim 1, wherein the titanium alloy includes not less than 30 atom % of Nb.

15. A wood-type golf club head according to claim 1, wherein the titanium alloy includes 10 to 40 atom % of Ta.

16. A wood-type golf club head according to claim 1, wherein the titanium alloy includes not less than 30 atom % of Ta.

17. A wood-type golf club head according to claim 1, wherein the titanium alloy includes 10 to 40 atom % of and Ta.

18. A wood-type golf club head according to claim 1, wherein the titanium alloy includes not less than 30 atom % of Nb and Ta.

* * * * *